United States Patent [19]

David et al.

[11] 4,139,337

[45] Feb. 13, 1979

[54] APPARATUS FOR THE MANUFACTURE OF ORTHOPEDIC INSOLES

[76] Inventors: Loic David, 38690 Le Grand Lemps, Chemin des Prairies, Isere; Peter Handlbauer, 2 bis, rue des Poilus, Nice-Villeneuve Loubet, both of France

[21] Appl. No.: 863,411

[22] Filed: Dec. 22, 1977

[30] Foreign Application Priority Data

Dec. 23, 1976 [FR] France ..... 76 39351

[51] Int. Cl.[2] ..... B29D 31/00; B29C 17/00

[52] U.S. Cl. ..... 425/2; 425/119

[58] Field of Search ..... 425/2, 119, 129 S

[56] References Cited

U.S. PATENT DOCUMENTS

| | | | |
|---|---|---|---|
| 3,310,885 | 3/1967 | Alderson | 425/2 X |
| 3,380,123 | 4/1968 | Schmidt | 425/119 |
| 3,444,586 | 5/1969 | Dubner | 425/2 X |
| 3,458,898 | 8/1969 | Casparis | 425/2 |
| 3,541,646 | 11/1970 | Baudou | 425/119 |
| 3,655,306 | 4/1972 | Ross et al. | 425/2X |
| 3,684,417 | 8/1972 | Baudou | 425/119 |

*Primary Examiner*—J. Howard Flint, Jr.
*Attorney, Agent, or Firm*—Karl F. Ross

[57] ABSTRACT

An apparatus for producing molded insoles from thermoplastic material comprises a box-shaped housing enclosing heating means for heating an insole. The housing has a window on an upper surface in which three faces of a prismatic body can be selectively positioned. One face forms a podoscope, another a measuring surface and the third a molding surface. A post on the housing has arms to support the user and adjustable knee rests.

6 Claims, 2 Drawing Figures

APPARATUS FOR THE MANUFACTURE OF ORTHOPEDIC INSOLES

FIELD OF THE INVENTION

The present invention relates to an apparatus for the manufacture of orthopedic insoles with multiple uses and, more particularly orthopedic insoles usable for sporting footwear especially for ski and mountaineering boots.

BACKGROUND OF THE INVENTION

Considering, for example, ski boots, it is desirable that the foot of the skier rest perfectly and form-fittingly on the bottom of the ski boot so that the skier can ski without tiring and can impart to the ski the necessary movements without the development of play between the foot and the boot prejudicial to the practice of skiing, particularly to a good "prise de carre".

To achieve this goal it is thus known to place at the interior of the ski boot insoles accurately reproducing the anatomic shape of the foot; and it is thus also known to form such insoles of foils constituted of thermoplastic material.

OBJECTS OF THE INVENTION

It is the principal object of the invention to provide an improved apparatus for the design and fabrication of anatomically correct insoles, particularly for sporting footwear such as ski boots.

Another object of the invention is to provide an apparatus facilitating the preparation of form fitting inserts for shoes and footwear of all types.

SUMMARY OF THE INVENTION

The invention attains these and other objects which will become apparent hereinafter by providing a combination of a podoscope for examining and measuring the bottom face or sole of the foot, locating means for marking the position of the foot on the podoscope and means for the forming of an insole of plastic material on a bearing surface replacing the podoscope but provided with the same locating means for the positioning of the foot.

This apparatus can, moreover, comprise means for positioning the knees in the position which determines the best bearing of the foot on the bearing surface or interior of the shoe by control of such bearing on the podoscope.

Various embodiments of this apparatus are possible within the precepts of the invention. According to a feature of the invention the apparatus comprises a housing provided with a vertical column on which two concave trough-shaped cradles serving as supports for the two knees are positioned in an adjustable manner vertically, longitudinally and laterally. The parallelepipedal housing having on its upper face an opening through which each of the four faces of a rectangular parallelepipedal body is exposed and lies horizontally. The body is rotatably mounted around a horizontal axis and is lockable or indexable in position so that its upper face intended to serve as a rest for the foot is horizontal.

This parallelepipedal body constitutes one of the essential elements of the apparatus. Advantageously this body contains a mirror which, in combination with one of its four principal faces constituted by a plate-glass, assumes the role of a podoscope, while a second face is arranged to permit the measuring of the foot and a third face comprises a relatively soft or pliable coating or covering and a zone having the shape of a plantar arch serving as footrest during the molding of the sole, all of the three aforementioned faces being provided with identical locating means for the positioning of the foot.

The insole is formed from thermoplastic material which requires its previous heating. To this effect, an apparatus according to the invention, comprises advantageously heating means such as a furnace or oven within the housing.

Finally, it is important to note that, for obtaining a very effective sole, it is necessary that it be shaped by the user himself, not only in the adequate position determined thanks to the podoscope and the two kneecaps, but also as a result of the firm bearing of the foot on the insole. It is thus imperative that the user transfer his maximum body weight onto the foil insole, as is done during the examination of the foot by the podoscope. To facilitate this, the apparatus comprises handles on the column or post allowing the user to maintain his equilibrium when practically standing on one foot.

BRIEF DESCRIPTION OF THE DRAWING

The invention will be better understood and its advantages as well as other characteristics will be apparent from the following description, reference being made to the accompanying diagrammatic drawing in which.

SPECIFIC DESCRIPTION

Figure 1:
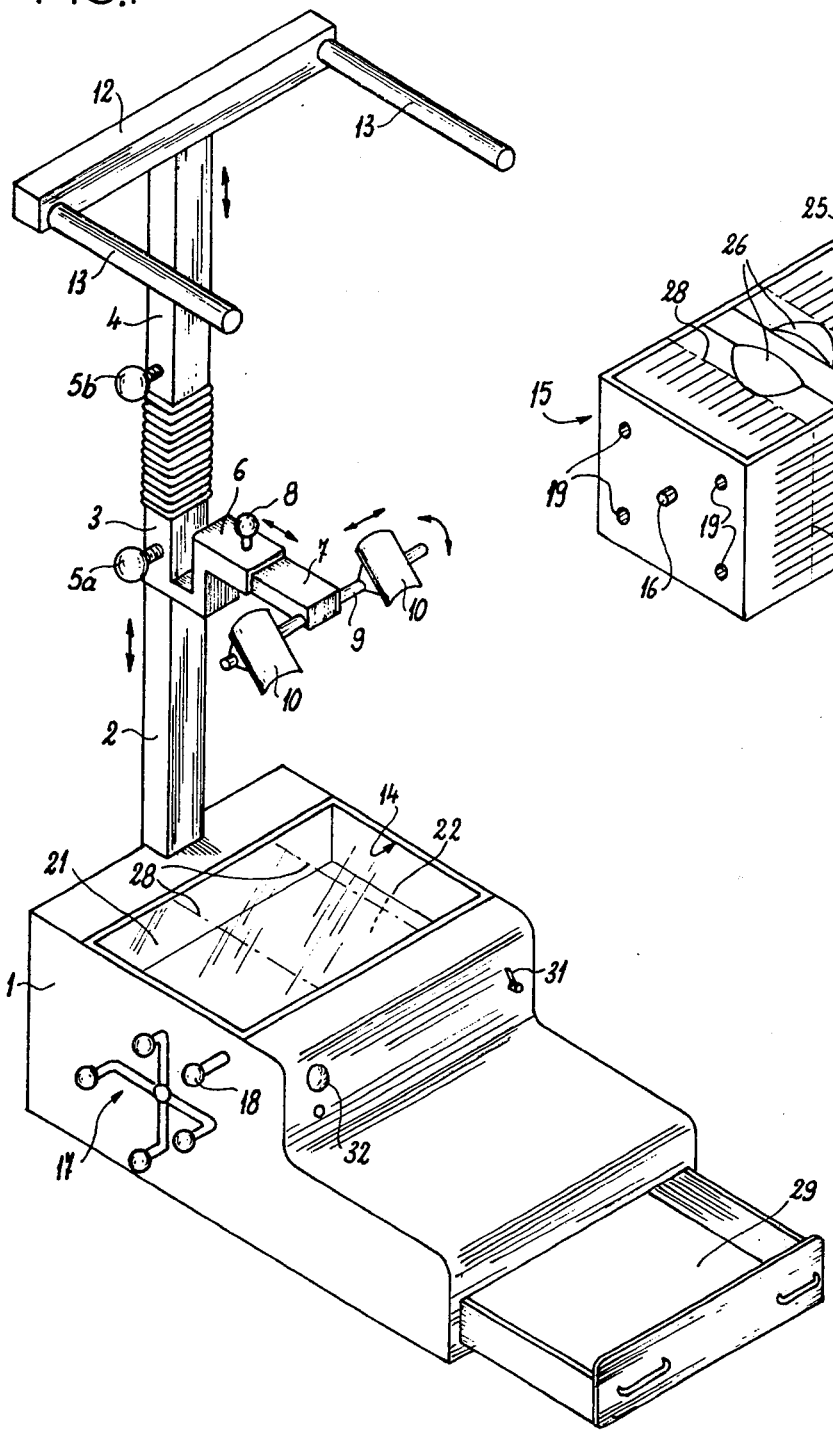
FIG. 1 is a perspective view showing the apparatus illustrated in its position in which the podoscope appears at the upper face of the housing of the apparatus.
Figure 2:
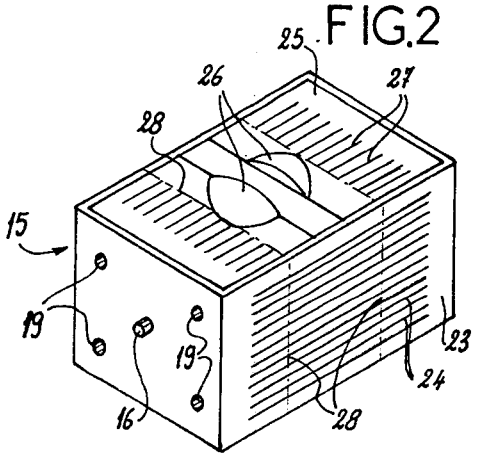
FIG. 2 is a perspective view of the inner parallelepipedal element or body shown alone but in a position different from that illustrated in FIG. 1.

The lower part of the apparatus has the form of a box-like housing 1 concealing and enclosing a framework, not shown in the drawing, rigid with a rectangular cross section column or post 2. Two tubular elements 3, 4 respectively of rectangular crossection are individually slidably mounted on the post 2, said elements being lockable in adjustable positions by the set-screws operable by handles **5*a* and 5*b*** respectively.

Rigid with the tubular element or sleeve 3 is the support 6 of a small bar 7 which is movably mounted in this support and is lockable in position by means of a screw operable by a handle 8. The bar 7 itself serves as a support for a transverse and horizontal rod 9 receiving cradles 10 displaceable in translation and in inclination and lockable in the desired position. These cradles 10 are intended to be used as supports to the two knees of the user. They will thus be designated hereafter as knee cradles.

A transverse bar 12, rigid with support 4, which is set at an adjustable height on the column 2, receives two longitudinal arms 13 serving as handles.

The housing 1 has on its horizontal upper face a rectangular opening 14 through which one of the four faces of a rectangular parallelepipedal body 15, received inside the housing, appears. This body 15 is constituted of two parallel lateral sides joined by four faces and by an axle 16 rotatable on pivots or bearings provided in the two principal vertical lateral faces of the housing 1 or pivotally supported by the framework in this housing. At one of its extremities the axle 16 receives a handwheel 17 for rotating the parallelepipedal body 15 inside the housing 1. A lock or indexing pin 18 cooperates selectively with four orifices 19 drilled into the corresponding lateral face of the parallelepipedal body 15 and permits the fastening of the body in four positions in each of which one of the faces of this body appears through the opening 14 of the housing 1.

The four principal faces of the parallelepipedal body 15 are differently arranged from one another. Thus:

one of the faces is formed of a glass-plate 21 which cooperates with a mirror 22 inside the body 15 to constitute a podoscope;

another face 23, constituted of any kind of material, is provided with a plurality of parallel lines 24 which make it possible to measure the foot in order to determine the size of the insole;

a further face is constituted by a plate 25 made of a relatively flexible material. This plate 25 has, on the one hand, two bosses 26 profiled in the form of plantar arches and, on the other hand, parallel lines 27 corresponding to the lines 24 of the aforementioned face; and the last face can be provided with any other desired arrangements. Thus, for example, in the case of an apparatus for the manufacture of orthopedic insoles for ski boots, it is possible to provide on this fourth face means for the fastening of a pair of ski boots during the molding operation of the inner lining which certain boots use.

The three essential faces of the parallelepipedal body 15 are thus 21, 23 and 25. These three faces all have the same arrangement of locating lins 28 (locating means) which make it possible to accurately position the foot when it rests successively on each of these faces.

The housing 1, finally, contains a furnace for heating the thermoplastic foils from which the insoles are made. The heating elements of the furnace are not shown in the drawing. Only drawer 29 is illustrated into which the soles are introduced for heating. A switch 31 of the heater puts the furnace in operation and the heater-controlling thermostat 32 regulates the temperature.

When a pair of orthopedic insoles is to be produced with this apparatus, the first operation consists of measuring the size of the foot of the user who then stands with his two feet on the face 23 of the parallelepipedal body 15, which, of course, has previously been set at the desired position inside the housing 1, and for this measuring operation the feet are aligned along the lines 28.

Before rotating the parallelepipedal body 15 in order to bring its face 25 to the upper part of the housing 1, that is to say, before placing the heated insole which was selected as a result of the previously effected measuring on the plate 27, it is convenient to previously determine very accurately the position which the foot is to take during the molding of the sole.

For this purpose, the parallelepipedal body 15 is brought by the wheel 17 into the position represented in FIG. 1, that is to say, into the position in which glass-plate 21 lies at the upper face of the housing 1. The user steps onto the parallelepipedal body 15, i.e. onto the glass-plate 21 of the podoscope, taking care to align his feet with the two lines 28 thereof. The person in charge of producing the insoles adjusts vertically, longitudinally, transversally and in inclination the position of the knee cradles 10, so that the two knees of the user can rest in a predetermined position as a result of which the pressure of the two feet on the glass plate 21 takes place in the best of conditions. This position is easily determined since the bottom face of the foot is reflected on the mirror 22 visible through the glass-plate 21. In order to obtain the best pressure of the feet on the glass-plate 21, the user must transfer the maximum of his weight to his feet. The two arms 13 help him, in these conditions, to maintain his equilibrium.

When the knee cradles 10 thus have been positioned, so that successively the two feet of the user take the best bearing position on the glass-plate 21, the user steps down from the apparatus and by means of a wheel 17 the parallelepipedal body 15 is rotated so that its face 25 appears at the upper surface of the housing.

The user then steps onto this face, after having placed on it the insole to be molded, i.e. the insole which has been retracted from the drawer 29, that is to say, the preheating furnace. Thanks to the various locating lines provided on the plate 27, the sole is, of course, correctly positioned; and the user needs then only to give the sole its definitive form by applying his foot to it, but taking care, of course, that thanks to the locating lines 28, the foot occupies accurately the same position as on the podoscope formed by the glass-plate 21 and the mirror 22.

The foot is thus positioned on the insole which is itself on the plate 27 and the user, whose two knees are sustained by the knee cradles 10, then transfers the maximum body weight onto each sole in the process of being formed while manually holding himself on the arms 13.

In the case of soles for ski boots, it is advantageous that the manufacture of the two soles of a same pair of shoes be made successively, because it is imperative that the insole of one ski boot be formed by the maximum effort each foot can exert on the bottom of the shoe.

In the case of footwear other than that intended for skiing, it is possible to produce simultaneously the two soles of a given pair, since it suffices that the body weight be distributed on both feet.

The invention is, of course, not limited to the manufacture of orthopedic insoles for the kinds of footwear specifically mentioned on the contrary, its fields of application extends to the manufacture of all othopedic soles whatever their ultimate purpose may be. It is also obvious that the invention is not limited to the single embodiment of the apparatus described above and illustrated by way of example but embraces all variations within the spirit and scope of the appended claims.

We claim:

1. An apparatus for the manufacture of orthopedic insoles of thermoplastic material, comprising in combination a podoscope for the examination of the bottom face of the foot, first locating means for marking the position of the foot on the podoscope, means for the molding of a sole of thermoplastic material on one bearing surface replacing the podoscope and second locating means on said bearing surface corresponding to said first locating means for the positioning of the foot.

2. The apparatus defined in claim 1, further comprising means for positioning the knees of a user in the position which determines the best bearing of the foot on the ground and is determined by the control of said bearing on the podoscope.

3. The apparatus defined in claim 2 comprising a housing, a vertical column on the housing, adjustable knee cradles vertically, longitudinally and laterally adjustable on said column and serving as said means for position said knees, said housing having on its upper face an aperture through which each of at least three angularly adjoining faces of a parallelpipedal body is selectively exposed, said body being rotatably mounted on a horizontal axis and lockable in position so that its selected upper face, intended for use as a footrest, is horizontal.

4. The apparatus defined in claim 3 wherein said parallelepipedal body contains a mirror which, in combination with one of its said faces constituted by a glass-plate assumes the role of the podoscope, another of said faces permitting the measuring of the foot, and a third of said faces comprising a flexible coating and an area formed as plantar arch and serving as a footrest during the molding of the insole, all of the three faces having identical locating means for the positioning of the foot.

5. The apparatus defined in claim 3 wherein said column supporting the two knee cradles is elongated upwardly by a support of adjustable height and carrying two arms.

6. The apparatus defined in claim 3, further comprising a furnace in said housing for preheating the insoles prior to their molding.

* * * * *